US006302191B1

(12) United States Patent
Wickham et al.

(10) Patent No.: US 6,302,191 B1
(45) Date of Patent: Oct. 16, 2001

(54) HEAT EXCHANGER

(75) Inventors: Mark Frederick Wickham, Northants; Richard Jamieson, Middlesex, both of (GB)

(73) Assignee: Alstom UK Limited (GB)

( * ) Notice: Subject to any disclaimer, the term of this patent is extended or adjusted under 35 U.S.C. 154(b) by 0 days.

(21) Appl. No.: 09/485,373

(22) PCT Filed: Jun. 8, 1999

(86) PCT No.: PCT/GB99/01657

§ 371 Date: Apr. 10, 2000

§ 102(e) Date: Apr. 10, 2000

(87) PCT Pub. No.: WO99/64806

PCT Pub. Date: Dec. 16, 1999

(30) Foreign Application Priority Data

Jun. 8, 1998 (GB) ..... 9812238

(51) Int. Cl.[7] ..... F28F 27/02
(52) U.S. Cl. ..... 165/103; 165/DIG. 113
(58) Field of Search ..... 165/102, 103, 165/159

(56) References Cited

U.S. PATENT DOCUMENTS

| | | | | |
|---|---|---|---|---|
| 3,392,777 | * | 7/1968 | Edgemond, Jr. et al. | 165/103 |
| 3,991,821 | * | 11/1976 | Cook et al. | 165/103 |
| 4,371,054 | | 2/1983 | Wirt . | |
| 4,498,524 | * | 2/1985 | Jacobsen | 165/103 |
| 5,396,760 | | 3/1995 | Hines . | |

FOREIGN PATENT DOCUMENTS

| | | |
|---|---|---|
| 554803 | 2/1957 | (BE) . |
| 42 07 677 A1 | 9/1993 | (DE) . |
| 43 10 538 A1 | 10/1994 | (DE) . |
| 0 357 907 A1 | 7/1989 | (EP) . |
| 415986 | 9/1934 | (GB) . |

* cited by examiner

*Primary Examiner*—Allen Flanigan
(74) *Attorney, Agent, or Firm*—Kirschstein, et al.

(57) ABSTRACT

A heat exchange unit for hot gas heat recovery has a heat exchange array situated within a heat exchange duct defined between a cylindrical outer casing and an axially slidable inner sleeve. The sleeve, together with a plug valve at the upper end of the unit, forms a variable position sleeve valve arrangement which simultaneously controls the flow of hot gas through the heat exchange duct and the bypass duct.

8 Claims, 6 Drawing Sheets

HEAT EXCHANGER

FIELD OF THE INVENTION

This invention relates generally to heat exchangers having internal bypass arrangements which may be actuated to control the bypass of hot gas around a heat exchanger array and to direct gas flow into a bypass circuit. It particularly relates to beat exchangers associated with gas turbines and gas/diesel engines for extracting heat from their exhaust gases.

BACKGROUND OF THE INVENTION

Heat exchangers of the type used to recover heat from gas turbine or gas/diesel engine exhaust gas are commonly designed with a bypass circuit situated external to the heat exchanger array and its casing, with the exhaust gas flow to the heat exchanger array circuit and the bypass circuit controlled by one or two flap valves or the like, such valves being known as dampers. Arrangements are known in which a single damper controls the flow through both circuits. Alternatively, two damper arrangements are known, in which one damper controls the flow through the heat exchanger array circuit and the other damper controls the flow through the bypass circuit. Both types tend to be heavy, bulky and complicated and when such dampers have been continuously modulated for continuously variable flow control reliability problems have been experienced. For example. with two damper arrangements, damage to engines has been caused by excessive back-pressure due to both dampers being closed at the same time, instead of one circuit always being open.

BRIEF DESCRIPTION OF THE INVENTION

According to the present invention, a heat exchange unit for exhaust gas heat recovery has heat exchange duct means, bypass duct means, heat exchange array means situated within the heat exchange duct means, and a variable position sleeve valve arrangement adapted to cause variable amounts of exhaust gas to flow through the bypass duct means instead of the heat exchange duct means, the heat exchange array means surrounding the variable position sleeve valve arrangement and the latter defining the bypass duct means and an inner wall of the heat exchange duct means, the variable position sleeve valve arrangement including sleeve means moveable axially of both duct means thereby simultaneously to control flow of exhaust gas through the heat exchange duct means and the bypass duct means.

Preferably, the sleeve means is adapted to be axially continuously moveable between two extreme positions with respect to inlet means for the heat exchange duct means and outlet means for the bypass duct means, whereby at one extreme position the inlet means for the heat exchange duct means is open and the sleeve means obturates outlet means for the bypass duct means and at the other extreme position the sleeve means obturates the inlet means for the heat exchange duct means and the outlet means for the bypass duct means is open.

One benefit of the current invention is that the modulating sleeve valve mechanism is an integral part of the heat exchange unit, rather than a separate piece of equipment, and is much simpler in its design than the prior art damper, making modulation more reliable. A further benefit is the intrinsically safe nature of the sleeve valve arrangement, wherein it is not possible to close off both gas flow paths at the same time, thereby protecting the upstream equipment from overpressure damage. A further benefit is that the current invention is lighter and requires less space than the prior art arrangements, which is of considerable benefit in offshore applications.

Furthermore in the known designs it is usual for there to be a separate sound attenuator installed in the gas circuit either upstream or down stream of the heat exchanger unit. In the current invention it is possible to favorably design the unit with sound attenuation linings on one or both sides of the sleeve means to damp sound in the bypass duct and/or the heat exchanger duct. It is possible also to provide the bypass duct with a flow splitter situated in the center of the sleeve means, the flow splitter also having a sound attenuating lining on its surface confronting the sleeve means. These measures would be intended to eliminate the requirement for a separate attenuation device.

Further features and advantages of the invention will be apparent from the following description and the claims.

BRIEF DESCRIPTION OF THE DRAWINGS

Exemplary embodiments of the invention will now be described with reference to the accompanying drawings, in which.

DETAILED DESCRIPTION OF EMBODIMENTS OF THE INVENTION

Figure 1:
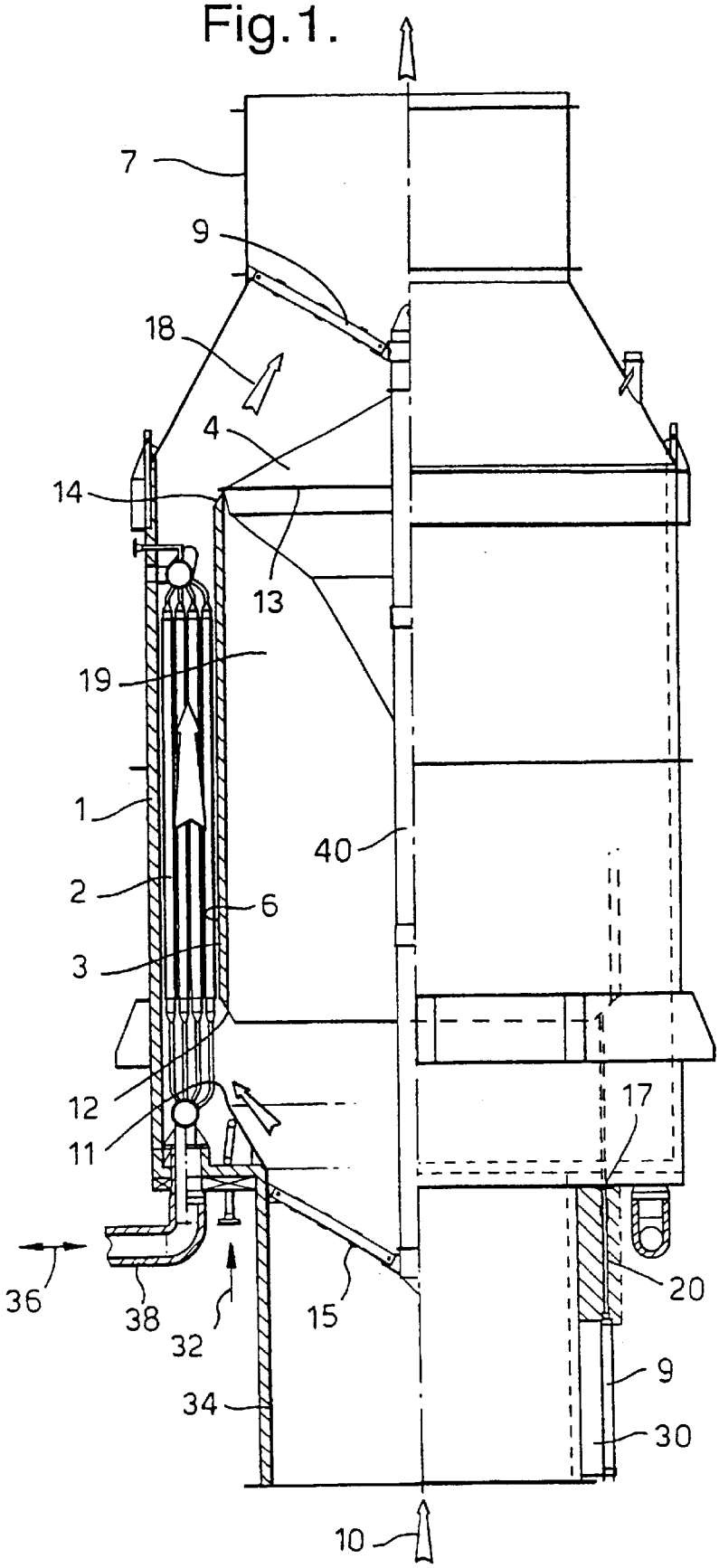
FIG. 1 is an elevation partly in section along the centerline of a heat exchanger unit in accordance with the invention, with an inner sliding sleeve valve shown positioned for passing hot gas through a heat exchanger array.

The heat exchange units shown in the Figures are exhaust gas heat recovery units suitable for use, e.g., in the offshore oil and gas industries. The units are generally cylindrical in shape and are drawn with their major axes oriented vertically. As indicated in FIG. 1, such a unit is intended to receive hot gas 10 through gas inlet duct 34 from a gas turbine engine or other type of engine (not shown), cool the gas by heat exchange with a fluid circulating in a heat exchanger array 2, and pass the cooled gas 18 onwards for venting from the gas exit duct 7 to a stack, or for further use. The heat exchange fluid 36 is passed in and out of the heat exchanger array 2 through concentric pipes 38. and can be used as process fluid or for generating steam. or the like.

Figure 2:
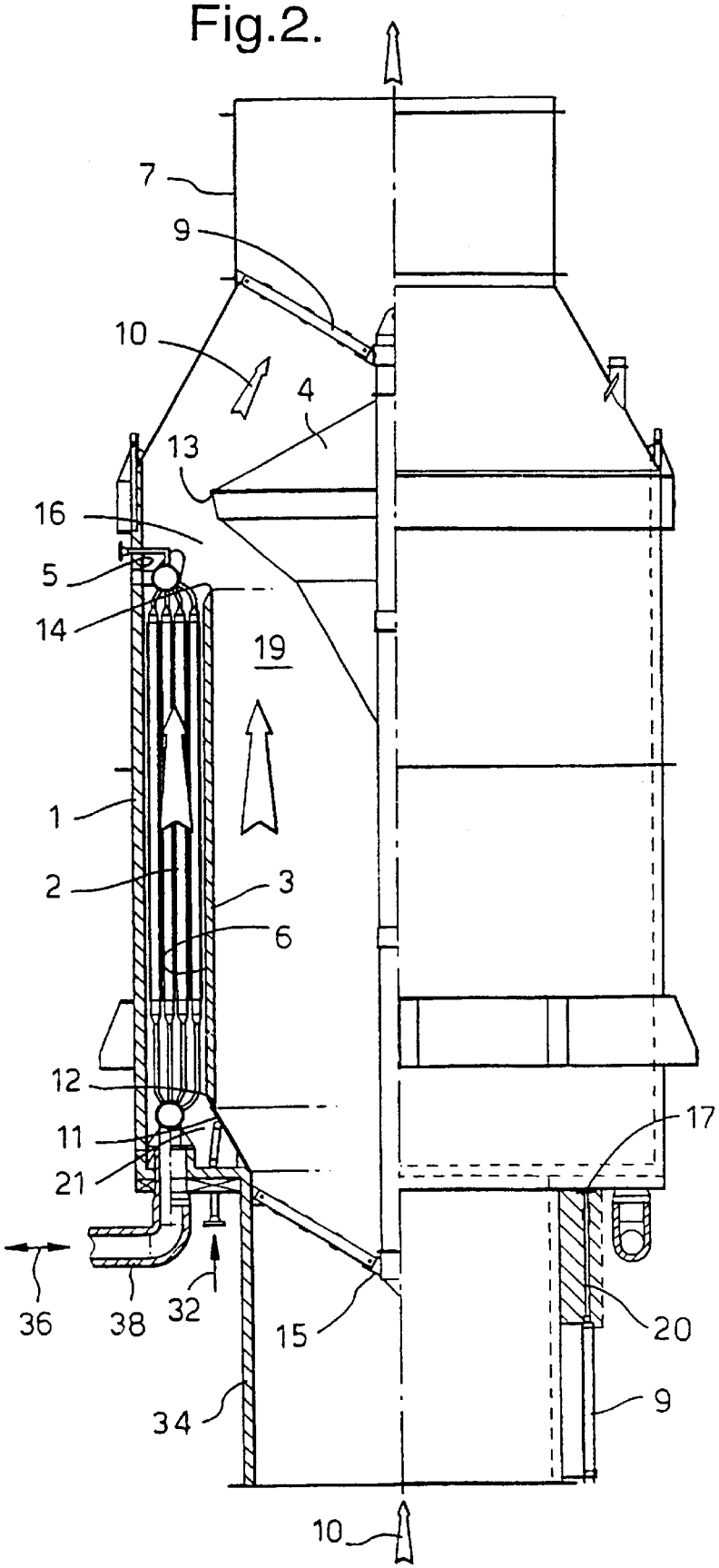
FIG. 2 is an elevation similar to FIG. 1 and showing the same heat exchanger unit, but with the sleeve valve shown positioned so that hot gas bypasses the heat exchanger array and passes through a central passage.

Referring to FIGS. 1 and 2 together, the heat exchange unit comprises a generally cylindrical outer casing or shell 1, containing an annular heat exchanger array 2, an internal sleeve valve 3, and a valve plug 4. The sleeve valve 3 is slideable axially within the heat exchanger array 2 between two extreme positions. In FIG. 1, the sleeve valve 3 is shown at its upper extreme position, so that the valve sleeve's central passage 19, termed a bypass duct, is effectively obturated, with substantially all the exhaust gas passing through the heat exchanger array 2. In this position, the required gas seal to prevent flow through the bypass duct 19 is provided when an upper "knife edge" 14 of sleeve valve 3 buts against a valve seat 13 provided on the valve plug 4.

In FIG. 2 the sleeve valve 3 is shown at its lower extreme position, such that substantially all the hot gas 10 passes through the bypass duct 19, so bypassing the heat exchanger array 2. In this position, a frusto-conical valve seat 12 on the bottom of sleeve valve 3 forms a gas seal with a complementary frusto-conical valve seat 11 attached to the shell 1 below the heat exchanger array 2. so causing the hot gas 10 to pass through the bypass duct 19 and out past the valve plug 4 through the annular opening 16 between the plug 4 and the outer components.

The plug 4 is supported at its axial position within the bypass duct 19, concentric with the shell 1, by means of a center post 40 which extends along the shell's longitudinal axis. Center post 40 is itself supported from the shell 1 by means of struts 9 and 15 which are provided respectively at the top and bottom of the center post 40. There should be at least three struts at each of the top and bottom positions, these struts being equiangularly spaced around the assembly.

As shown particularly in the right-hand (non-sectioned) part of FIG. 1, the sleeve valve 3 is attached at its lower end to rods 20 for moving the sleeve valve axially up and down within the heat exchanger unit. The rods pass through gas seals 17, and are actuated by one or more actuation devices 9 attached to the gas inlet duct 22 by support plates 30. The actuation devices 9 may be hydraulic, pneumatic, electrical, or manually operated. For example. the rods 20 and hence the sleeve valve 3 may be raised and lowered by means of ball screw devices on lead screws driven by electric motors. Again, there should be at least three rods 20, each driven by an actuation device, equiangularly spaced around the assembly.

Advantageously, air 32 may be introduced into the lower heat exchanger space 21 through gas seals 17, or alternatively into a space created by a multiple seated seal (not shown), for the purpose of performing a sealing function by achieving complete isolation of the heat exchanger circuit from the hot gas 10. Additionally, or alternatively, such air may be utilized to remove unwanted heat from the working fluid within the heat exchanger array 2 when the hot gas 10 passes only through the bypass duct 19.

For noise absorption within the heat exchanger duct, sound attenuation linings 5 and 6 are provided respectively on the inside of the shell 1 and on the outside of sleeve valve 3. The sound attenuation lining also has a temperature insulating function to reduce heat loss through the walls of the heat exchanger duct.

Figure 3:
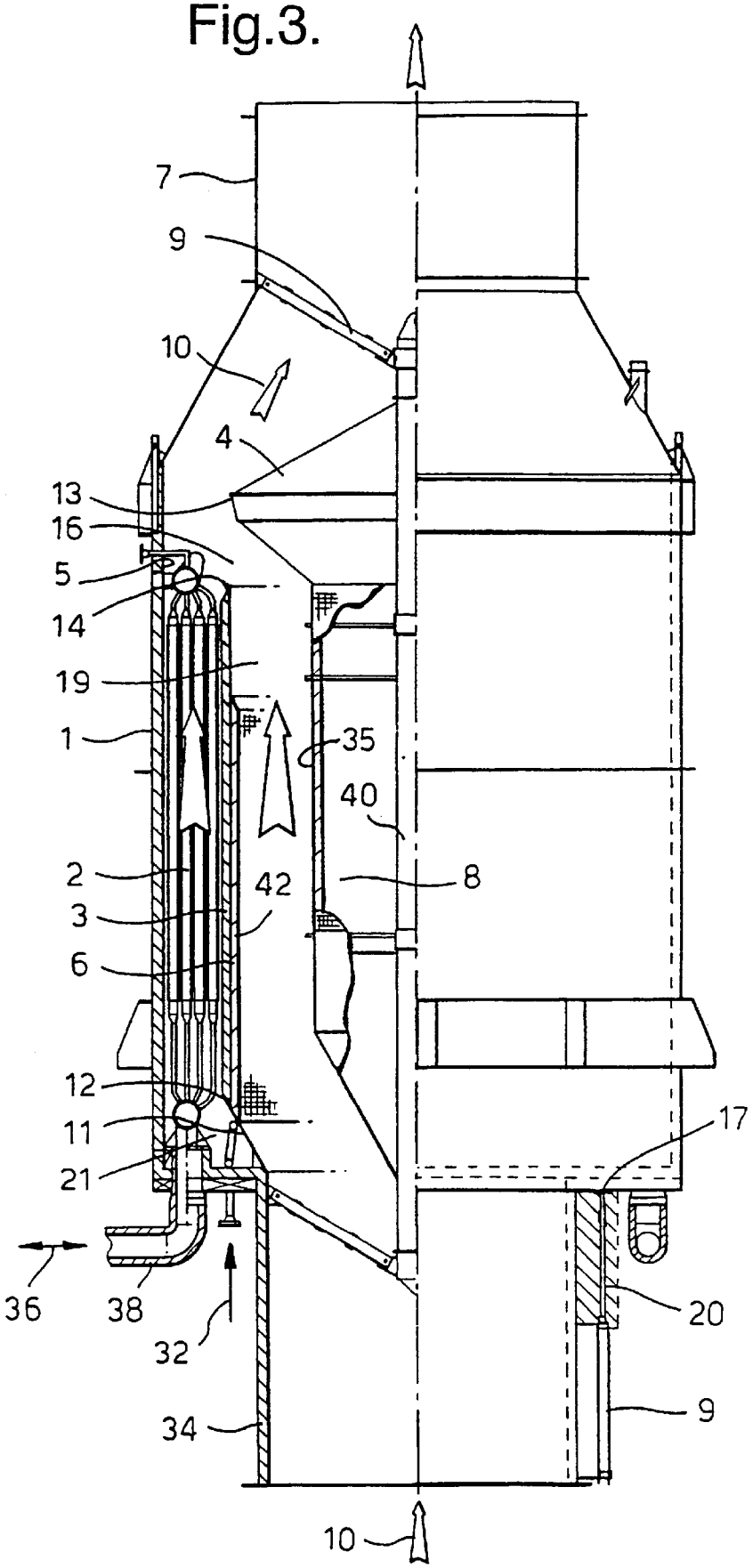
FIG. 3 is an elevation similar to FIG. 2, showing an alternative embodiment of the invention.

FIG. 3 shows a preferred embodiment of the invention. As in FIG. 2, the unit is shown with the bypass duct in the extreme open position, but here the valve plug 4 is provided with a downward extension 8 which passes axially through the bypass duct 19 concentric with the shell 1 and center post 40. The extension 8 acts as a flow splitter and has a cylindrical upper portion and a lower conical end portion. To provide improved sound attenuation in the bypass duct 19, the outer surface of the cylindrical portion of the flow splitter 8, confronting the sleeve valve 3, has a sound attenuating lining 35 over at least part of its length. Additionally, the lower part of the sleeve valve 3 is provided with a sound attenuating lining 42 on its internal surface. However, the top one fifth, approximately, of the sleeve valve 3 is not covered by lining 42, so as to avoid disturbing or restricting the flow of gas through the annular exit 16 of the bypass duct.

Figure 4A:
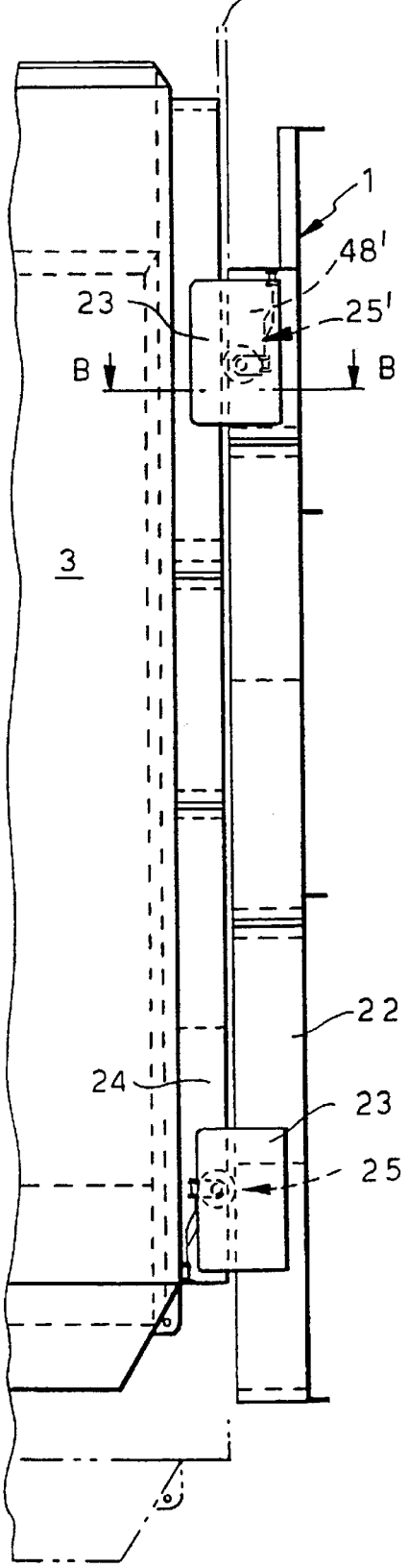
FIG. 4A is a side elevation of the sleeve valve showing how it may be guided to slide up and down within the heat exchanger unit.
Figure 4B:
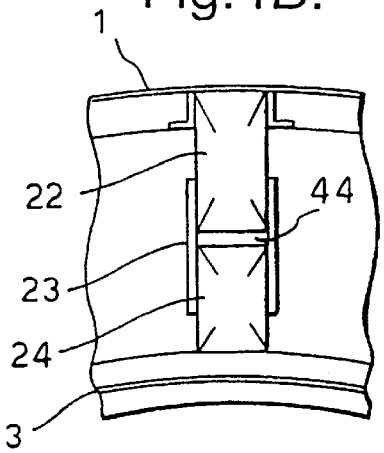
FIG. 4B is an enlarged view on section line B—B in FIG. 4A.
Figure 4C:
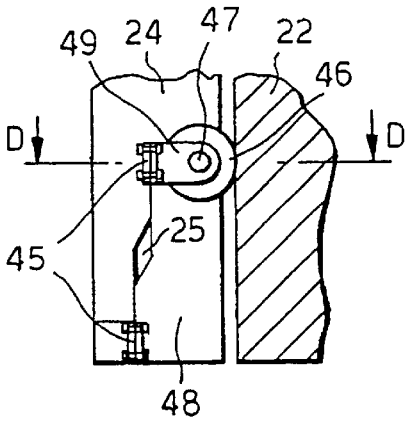
FIGS. 4C and 4D show in side elevation and sectional plan view respectively an enlarged detail of the guide mechanism, FIG. 4D being a view on section D—D in FIG. 4C.
Figure 4D:
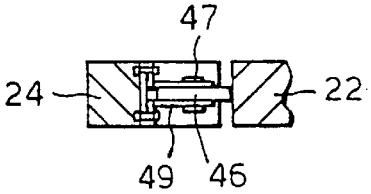

As shown in FIGS. 4A to 4D, lateral support of the sleeve, additional to that provided by rods 20, is required to prevent undue vibration of the sleeve valve and can be achieved in a number of different ways. In this embodiment the sleeve 3 is provided with three guide rails 24 secured to its external surface. These guide rails 24 extend lengthwise of the sleeve and are spaced 120 degrees apart around it. Similarly, the shell 1 of the unit is provided with three guide rails 22 which confront the rails 2. Dimensions are chosen so that there is a small clearance 44 between the confronting surfaces of the rails. Pairs of guide plates 23 are attached near the top and bottom of rails 22 and extend therefrom to embrace the rails 24 with a small clearance so as to prevent the rails 24 on the sleeve 3 from moving out of registration with the rails 22 on the shell 1. As shown in FIGS. 4A, 4C and 4D, the bottom portion of each rail 24 on the sleeve 3 comprises a roller mechanism 25, in which a roller wheel 46 is free to run along the surface of rail 22 by rotating on an axle 47. Axle 47 is held at each end by bearing plates 49, which are attached to the upper end of a roller block 48. Block 48 is in turn attached at its upper and lower ends to the rail 24 through vibration absorbing joints 45. As will be seen from FIG. 4A, a similar roller mechanism is provided at the upper end of each rail 22 on the shell 1. Roller mechanism $\mathbf{25}^1$ differs from roller mechanism 25 only in that its roller block $\mathbf{48}^1$ is attached to rail 22 and its roller runs along the surface of rail 24.

Figure 5:
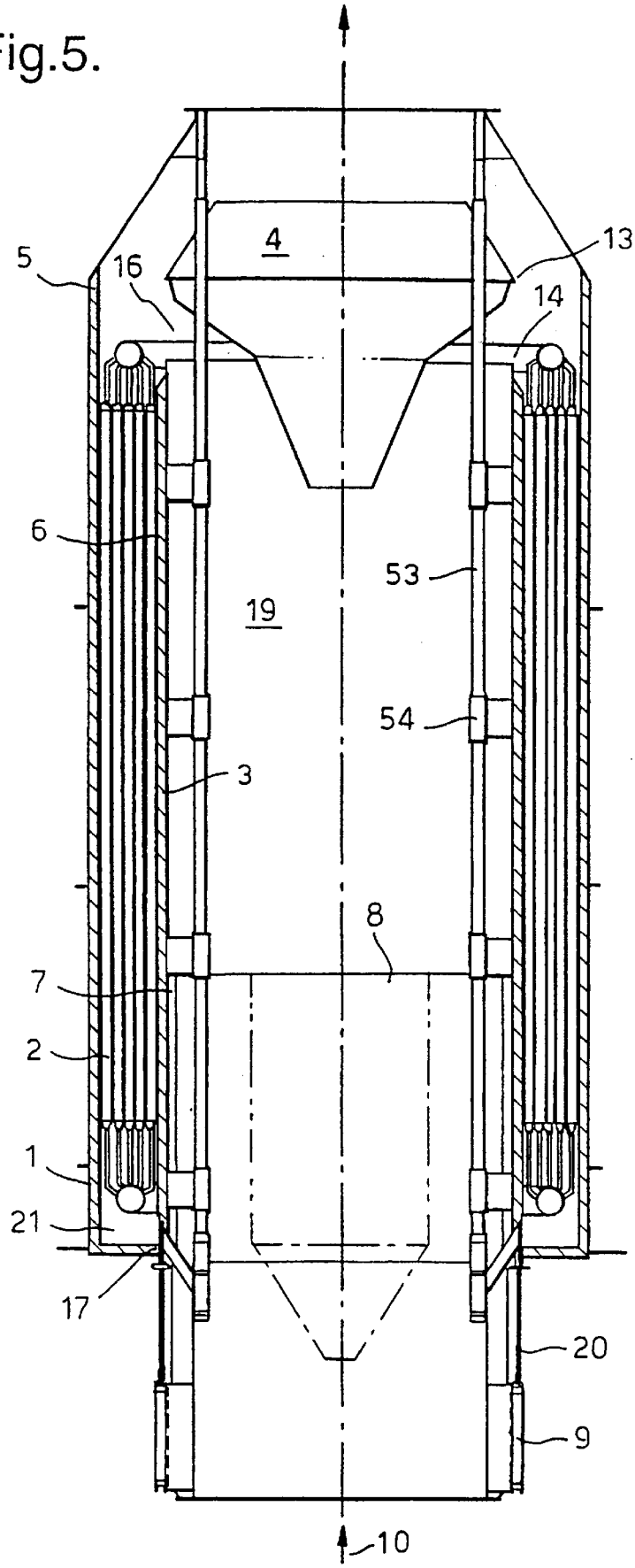
FIGS. 5 and 6 are sketches in part-sectional side elevation of alternative embodiments of the invention.
Figure 6:
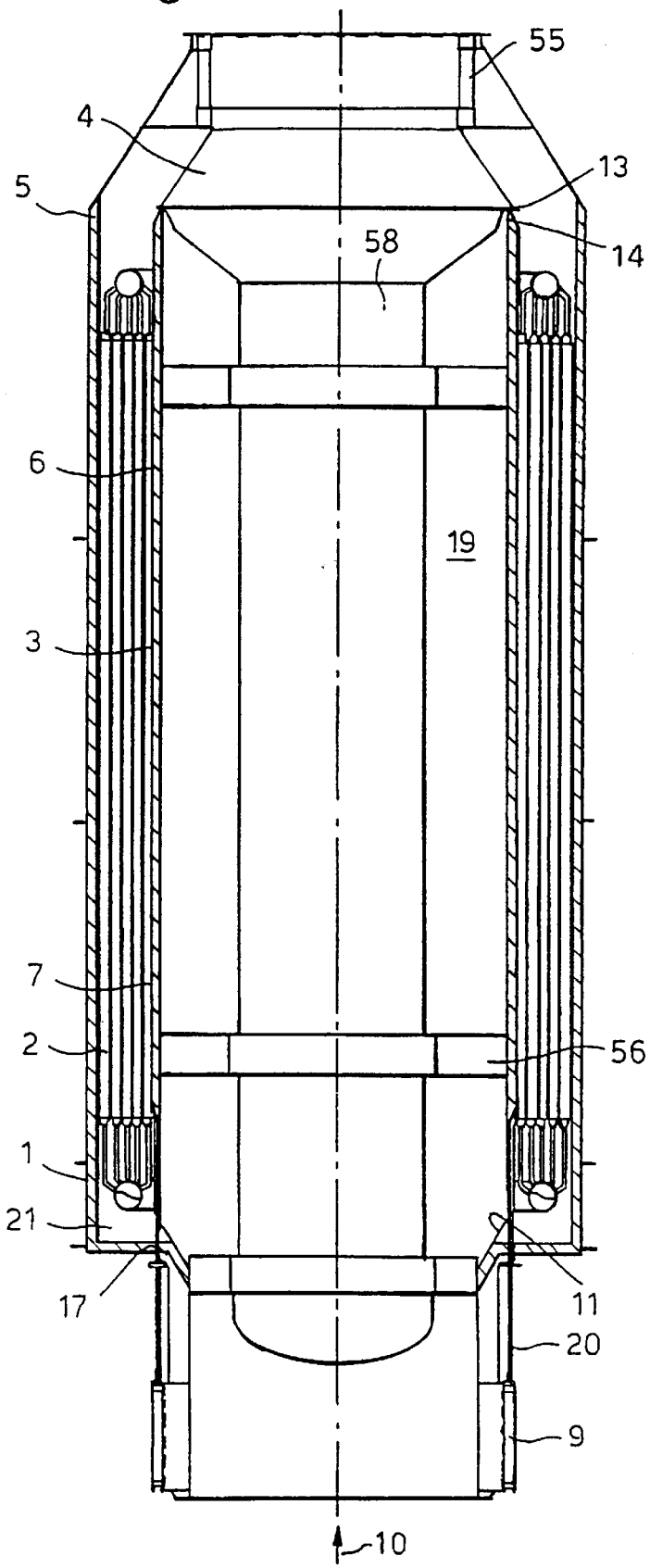

FIGS. 5 and 6 sketch alternative embodiments of the invention to illustrate alternative methods of guiding the sleeve valve 3. In FIGS. 5 and 6, similar items are given the same reference numbers as in FIGS. 1 to 4 and will not be further described, since they differ only in detailed dimensions and shape.

In FIG. 5, the sleeve 3, shown in its lowest position, is guided by four rods 53 connected at top and bottom to the outer casing 1. The valve plug 4 is also supported and by the rods 53 in order to align centrally with the sleeve 3. The sleeve 3 is permitted to slide along the rods by tubular bearings 54 attached to the sleeve 3. An additional feature of this embodiment is that the valve plug 4 is permitted to slide a small distance axially up the rods 53 to provide a means of limiting the load applied to the sleeve 3 and plug 4 by the actuator devices 9. This is to prevent damaging the equipment in the event of excessive axial upward movement of the sleeve 3 for any reason.

In FIG. 6, the unit is shown with the sleeve 3 in its uppermost position, i. e. with the bypass duct closed. In this embodiment, the plug seal 4 has a cylindrical extension 58 which extends axially down through the bypass duct 19 to a position below the valve seat 11. The top end of the plug 4 is laterally supported by plug support rods 55 which are attached to the outer casing 1. The valve sleeve 3 is guided and laterally supported from the plug 4 by two guide bearings 56.

Although FIGS. 1 to 6 above show the sleeve valve 3 in its two extreme positions, it should of course be understood that the position of the sleeve is variable according to the input from the actuators 9, so that intermediate positions could be adopted. thereby allowing some of the hot gas 10 to pass through the bypass duct 19 and some through the heat exchanger array 2.

Furthermore, although in the above-described arrangements the sleeve 3 defines both the bypass duct 19 and the inner wall of the heat exchange duct, it would also be possible to have an inner structural wall, additional to the moveable sleeve 3, to perform the function of dividing the bypass duct from the heat exchanger array.

There are other ways of arranging the internals of the heat exchanger apart from those shown in FIGS. 1 to 6 above which could be developed within the scope of this invention.

The casing 1, heat exchanger duct and internal bypass duct 19 are preferably cylindrical, however, shapes having a non-circular cross section are also functional.

The heat exchanger may also be configured to operate with the exhaust gas flowing in the opposite direction to that shown in the figures with only relatively minor modifications to the internals.

The heat exchanger is most suited to operation in a vertical arrangement as shown in all figures, however, it may also be operated in any other position, including horizontal and upside down, again with relatively minor modifications to the internals. The heat exchanger internals may also be altered to allow the plug to be situated at the other end of the heat exchanger, which may be beneficial in certain applications.

The position of the actuators and attachment of the actuator rods may be changed from the lower end of the heat exchanger to the upper end.

The sleeve may be actuated and guided by alternative means to those described above and as shown in the Figures, again within the scope of this invention.

What is claimed is:

1. A heat exchange unit with an intrinsically safe, internal bypass valve, comprising:

a) an outer casing;

b) a peripherally and longitudinally extending, heat exchanger array;

c) a sleeve valve movable axially relative to the heat exchanger array and forming the bypass valve;

d) a valve plug;

e) an outer casing valve seat; and f) actuation means for moving the sleeve valve to create a gas seal on the valve plug at one extreme of axial travel in order to cause a hot gas to flow through the heat exchanger array and, at an opposite extreme of travel, to create a gas seal on the outer casing valve seat in order to cause the hot gas to flow through a bypass duct comprising a central passageway of the sleeve valve, thereby bypassing the heat exchanger array.

2. The heat exchange unit according to claim 1, including means for introducing sealing air to an annular space between the outer casing valve seat and the heat exchanger array.

3. The heat exchange unit according to claim 1, the heat exchange unit being arranged in series with an engine to receive exhaust gas therefrom.

4. The heat exchange unit according to claim 1, wherein the bypass duct includes sound attenuation linings to reduce sound levels emitted from the unit.

5. The heat exchange unit according to claim 1, wherein the bypass duct is provided with a flow splitter to help guide the hot gas through the unit.

6. The heat exchanger unit according to claim 5, wherein the flow splitter comprises an extension of the valve plug.

7. A heat exchange unit for hot gas heat recovery, comprises:

a) heat exchange duct means;

b) bypass duct means;

c) heat exchange array means situated within the heat exchange duct means; and d) a variable position valve arrangement adapted to cause variable amounts of a hot gas to flow through the bypass duct means instead of through the heat exchange duct means, the heat exchange array means surrounding the variable position valve arrangement, the variable position valve arrangement including sleeve means movable axially of both the duct means for simultaneously controlling flow of the hot gas through the heat exchange duct means and the bypass duct means, the sleeve means being axially movable between two extreme positions with respect to an inlet means for the heat exchange duct means and an outlet means for the bypass duct means, whereby, at one of the extreme positions, the inlet means for the heat exchange duct means is open and the sleeve means obturates the outlet means for the bypass duct means and, at the other of the extreme positions, the sleeve means obturates the inlet means for the heat exchange duct means, and the outlet means for the bypass duct means is open.

8. The heat exchange unit according to claim 7, in which the sleeve means defines the bypass duct means and an inner wall of the heat exchange duct means.

* * * * *